US009900945B1

(12) United States Patent
Janik et al.

(10) Patent No.: US 9,900,945 B1
(45) Date of Patent: Feb. 20, 2018

(54) COLOR TEMPERATURE CONTROL

(71) Applicants: Raymond Janik, Fayetteville, GA (US); Ninglian Wang, Newnan, GA (US); Russell Scott Trask, Sharpsburg, GA (US); Kevin Mills, Newnan, GA (US)

(72) Inventors: Raymond Janik, Fayetteville, GA (US); Ninglian Wang, Newnan, GA (US); Russell Scott Trask, Sharpsburg, GA (US); Kevin Mills, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 14/702,351

(22) Filed: May 1, 2015

(51) Int. Cl.
*H05B 33/08* (2006.01)

(52) U.S. Cl.
CPC ..... *H05B 33/083* (2013.01); *H05B 33/0857* (2013.01)

(58) Field of Classification Search
CPC ... F21K 9/00; H05B 33/0863; H05B 33/0857; H05B 33/0815
USPC ..... 315/291, 297, 192; 362/231, 230, 84; 313/1
See application file for complete search history.

(56) References Cited

U.S. PATENT DOCUMENTS 4,186,337 A * 1/1980 Volk ..... F02P 17/00 324/380
2003/0112229 A1* 6/2003 Pong ..... H05B 33/0815 345/204
2009/0218960 A1* 9/2009 Lyons ..... G01J 1/32 315/297
2010/0026191 A1* 2/2010 Radermacher ..... H05B 33/0815 315/149
2011/0043137 A1* 2/2011 Negley ..... H05B 33/086 315/297
2011/0156596 A1* 6/2011 Salsbury ..... H05B 33/0869 315/152
2012/0025733 A1* 2/2012 Melanson ..... H02M 1/36 315/287
2012/0200229 A1* 8/2012 Kunst ..... H05B 33/0815 315/186
2013/0002157 A1* 1/2013 van de Ven ..... H05B 33/0824 315/192
2013/0187572 A1* 7/2013 Grajcar ..... H05B 33/0824 315/312
2014/0077721 A1* 3/2014 Melanson ..... H05B 33/0815 315/224

* cited by examiner

*Primary Examiner* — Douglas W Owens
*Assistant Examiner* — Wei Chan
(74) *Attorney, Agent, or Firm* — King & Spalding LLP

(57) ABSTRACT

A lighting device includes a first group of light emitting diodes (LEDs) that are in series with each other and that emit a first light having a first correlated color temperature (CCT). The lighting device further includes a second group of LEDs that are in series with each other and that emit a second light having a second CCT. The lighting device also includes an active electrical component in series with the second group of LEDs. The lighting device further includes a switch coupled in series with the second group of LEDs and the electrical component. The first group of LEDs is in a parallel configuration with the switch, the second group of LEDs, and the electrical component.

18 Claims, 7 Drawing Sheets

COLOR TEMPERATURE CONTROL

TECHNICAL FIELD

The present disclosure relates generally to lighting solutions, and more particularly to dimmable LED lighting.

BACKGROUND

Lighting devices generally adjust the color temperature of a light emitted by the LEDs of the lighting device in response to changes in the dim level of the light or the current amount from a power source such as an LED driver. For example, the lighting device may include a first string of LEDs and a second string of LEDs, where the two strings of LEDs have the same number of LEDs and are in parallel with each other. The first string of LEDs may emit a light that has a first correlated color temperature (CCT), and the second string of LEDs may emit a light that has a second CCT that is higher (cooler) than the first CCT. The CCT of the light emitted by the lighting device is generally the flux weighted combination of the CCTs of the two strings of LEDs.

When the current provided to the strings of LEDs is reduced to dim the combined light such that the combined light has a CCT that closely matches the first CCT (warmer), the second string of LEDs may remain powered on, which may prevent the CCT of the combined light from reaching the desired CCT. Thus, a solution that enables a light emitted by a lighting device to have a desired CCT at lower dim levels of the light is desirable.

SUMMARY

The present disclosure relates generally to lighting solutions, and more particularly to dimmable LED lighting. In an example embodiment, a lighting device includes a first group of light emitting diodes (LEDs) that are in series with each other and that emit a first light having a first correlated color temperature (CCT). The lighting device further includes a second group of LEDs that are in series with each other and that emit a second light having a second CCT. The lighting device also includes an active electrical component in series with the second group of LEDs. A voltage across both the second group of LEDs and the active electrical component that is needed for the second group of LEDs to start emitting the second light is higher than a voltage across the first group of LEDs that is needed for the first group of LEDs to start emitting the first light. The lighting device further includes a switch coupled in series with the second group of LEDs and the electrical component. The first group of LEDs is in a parallel configuration with the switch, the second group of LEDs, and the electrical component.

In another example embodiment, a lighting device includes a first group of light emitting diodes (LEDs) that are in series with each other and that emit a first light having a first correlated color temperature (CCT). The lighting device further includes a second group of LEDs that are in series with each other and that emit a second light having a second CCT. The lighting device also includes a third group of LEDs that are in series with each other and emit a third light having the second CCT. The lighting device 1000 further includes an electrical component in series with the second group of LEDs, where a voltage across both the second group of LEDs and the electrical component that is needed for the second group of LEDs to start emitting the second light is higher than a voltage across the first group of LEDs that is needed for the first group of LEDs to start emitting the first light. The lighting device also includes a switch coupled in series with the third group of LEDs, where the first group of LEDs is in a parallel configuration with the switch and the third group of LEDs and with the second group of LEDs and the electrical component.

In another example embodiment, a lighting device includes a first group of light emitting diodes (LEDs) that are in series with each other and that emit a first light having a first correlated color temperature (CCT). The lighting device further includes a second group of LEDs that are in series with each other and emit a second light having a second CCT. The lighting device also includes a third group of LEDs that are in series with each other and emit a third light having the first CCT. The lighting device further includes an electrical component in series with the second group of LEDs, where a voltage across both the second group of LEDs and the electrical component that is needed for the second group of LEDs to start emitting the second light is higher than a voltage across the first group of LEDs that is needed for the first group of LEDs to start emitting the first light. The lighting device also includes a switch coupled in series with the third group of LEDs, where the first group of LEDs is in a parallel configuration with the switch and the third group of LEDs and with the second group of LEDs and the electrical component.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

DETAILED DESCRIPTION OF THE EXAMPLE EMBODIMENTS

In the following paragraphs, example embodiments will be described in further detail with reference to the figures. In the description, well known components, methods, and/or processing techniques are omitted or briefly described. Furthermore, reference to various feature(s) of the embodiments is not to suggest that all embodiments must include the referenced feature(s).

Figure 1:
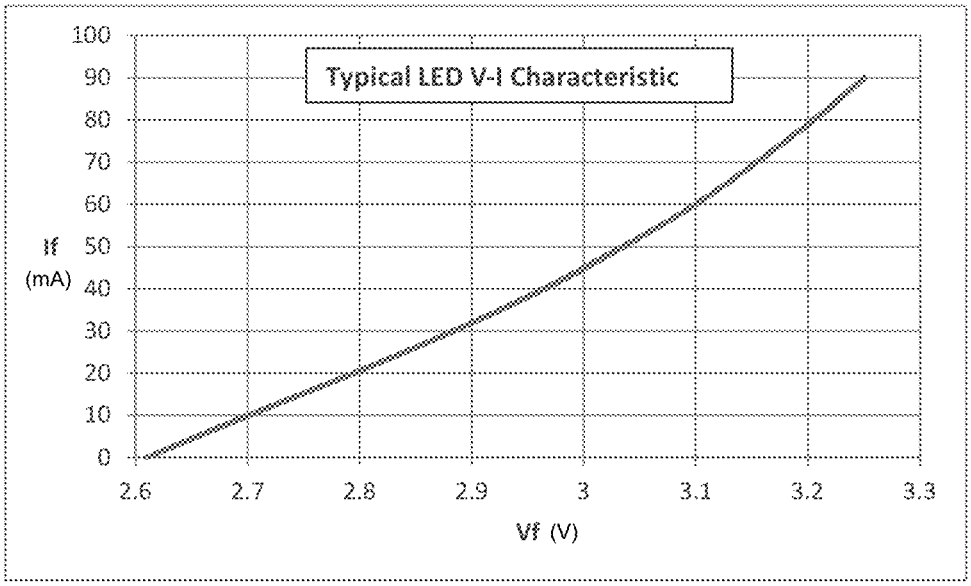
FIG. 1 is a plot illustrating voltage-current (V-I) characteristic of a typical light emitting diodes (LED) according to an example embodiment.

Turning now to the figures, particular embodiments are described. FIG. 1 is a plot illustrating voltage-current (V-I) characteristic of a typical light emitting diodes (LED) according to an example embodiment. As illustrated in FIG. 1, as the forward voltage ($V_f$) across the LED reaches and exceeds approximately 2.6 V, the current ($I_f$) starts flowing through the LED and increases along with an increase in the forward voltage ($V_f$). The non-linear relationship between $V_f$ and $I_f$ shown in FIG. 1 illustrates that a current source is better suited for providing power to the LED as a small change in $V_f$ may result in a large current swing that may damage the LED.

Figure 2:
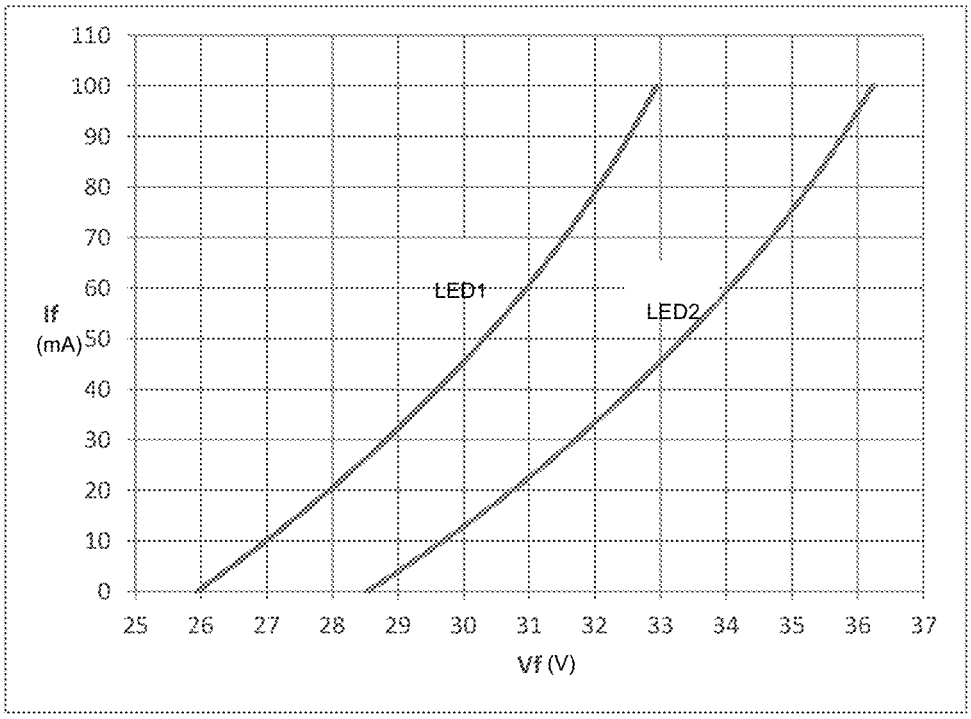
FIG. 2 is a plot illustrating voltage-current (V-I) characteristics of two groups of LEDs that are designed to emit lights having different color temperatures according to an example embodiment.

FIG. 2 is a plot illustrating voltage-current (V-I) characteristics of two groups of LEDs that are designed to emit lights having different color temperatures according to an example embodiment. The curve $LED_1$ corresponds to the V-I characteristics of a first group of ten LEDs (in series) ($LED_1$) that are designed to emit a light having a lower CCT. The curve $LED_2$ corresponds to the V-I characteristics of a second group of eleven LEDs (in series) ($LED_2$) that are designed to emit a light having a higher CCT. The additional one LED that is included in the second group of LEDs ($LED_2$) results in the second group of LEDs requiring a higher voltage for current to flow through the second group of LEDs ($LED_2$).

To illustrate, if the first group of LEDs ($LED_1$) and the second group of LEDs ($LED_2$) are coupled to each other in parallel, as a drive current provided to the two groups of LEDs increases, the first group of LEDs ($LED_1$) starts to conduct while the second group of LEDs ($LED_2$) remains turned off until the forward voltage ($V_f$) across the first group of LEDs ($LED_1$) and the second group of LEDs ($LED_2$) reaches approximately 28.6 V. Similarly, as the drive current provided to the groups of LEDs decreases (e.g., due to dimming by a dimmer), the second group of LEDs ($LED_2$) stops conducting current at approximately at 28.6 V while first group of LEDs ($LED_1$) continues to conduct current until approximately 26 V. Thus, in some example embodiments, the light resulting from the lights emitted by the first and second groups of LEDs may have a CCT that is the same as or that closely matches the CCT of the light emitted by the first group of LEDs ($LED_1$) when the second group of LEDs ($LED_2$) is not conducting current because of the additional LED that the second group of LEDs ($LED_2$) includes.

Although the first group of LEDs ($LED_1$) is described above as including ten LEDs and the second group of LEDs ($LED_2$) is described as including eleven LEDs, in alternative embodiments, the two groups of LEDs may include more or fewer LEDs while having a different number of LEDs such that the second group of LEDs ($LED_2$) has more LEDs than the first group of LEDs ($LED_1$) to maintain a difference in the threshold forward voltages of the two groups of LEDs.

Figure 3:
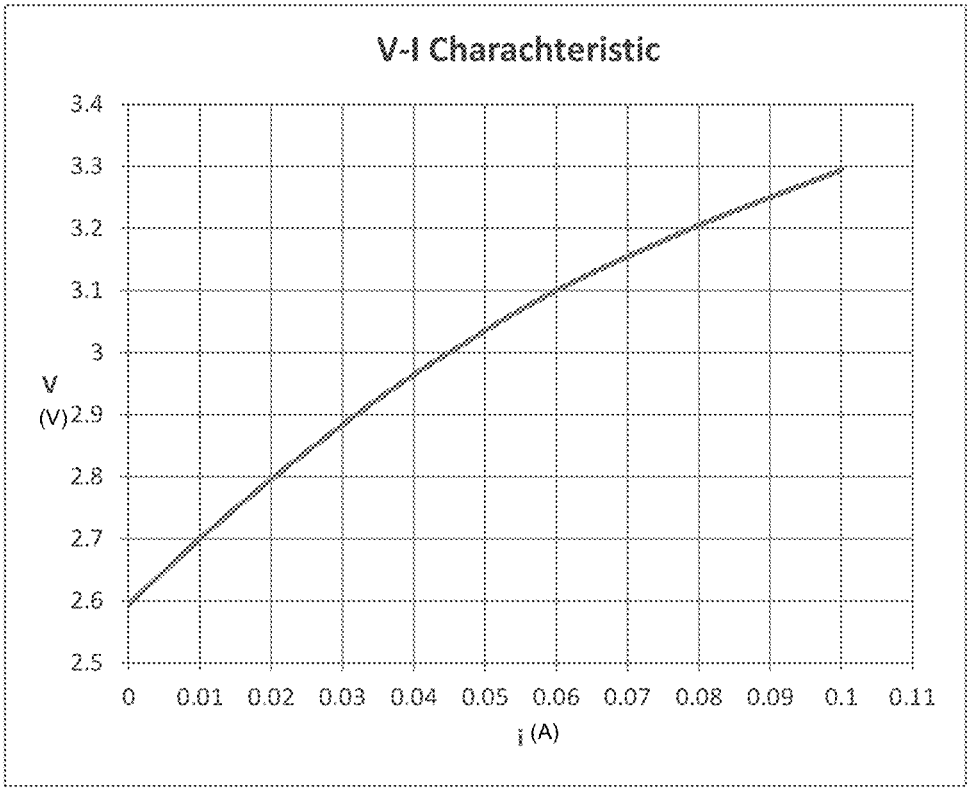
FIG. 3 is a plot illustrating a voltage-current (V-I) characteristic of a typical light emitting diode where the horizontal axis is the current and the vertical axis the voltage, and approximated by a third order polynomial according to an example embodiment.

FIG. 3 is a plot illustrating a voltage-current (V-I) characteristic of a light emitting diode and approximated by a third order polynomial according to an example embodiment. In some example embodiments, the third order polynomial is:

$$V=108i^3-53i^2+11i+2.59$$

Figure 4:
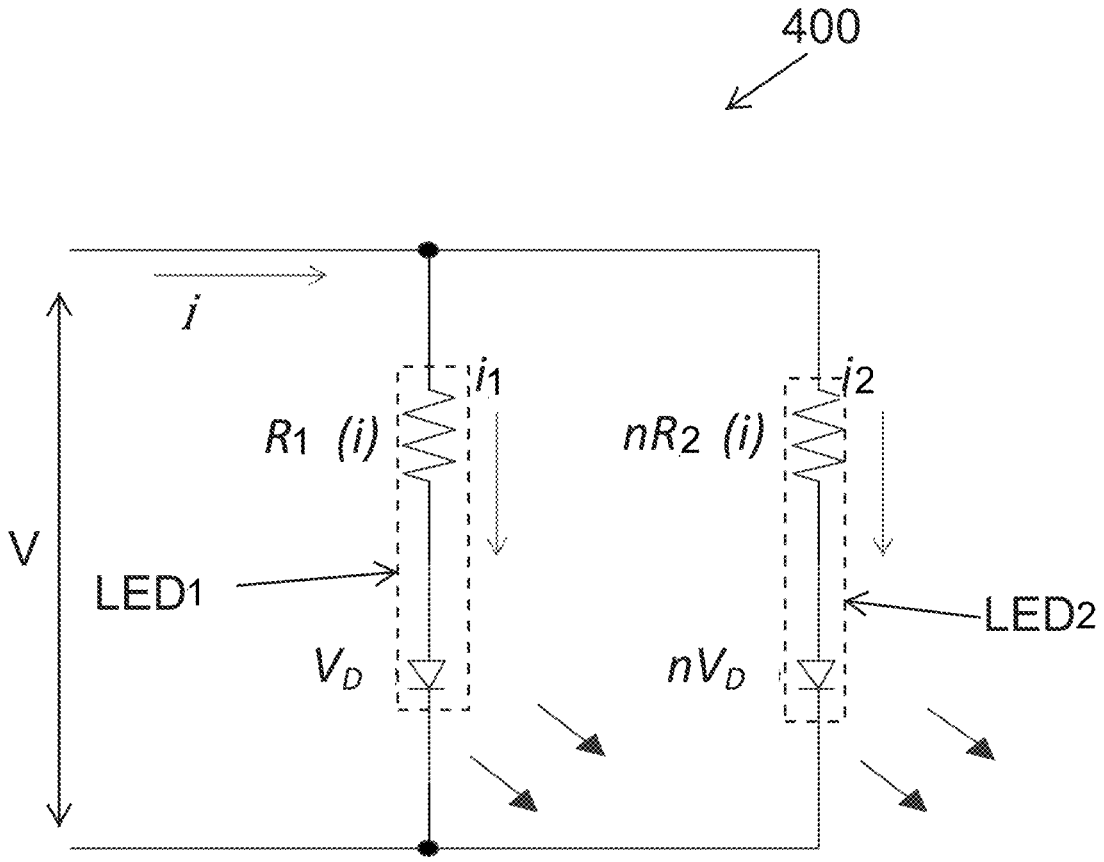
FIG. 4 is a light source 400 with two groups of LEDs as described with respect to FIG. 2 according to an example embodiment.

FIG. 4 is a light source/device 400 with two groups of LEDs as described with respect to FIG. 2 according to an example embodiment. In some example embodiments, $LED_1$ emits a relatively warm light (e.g., 1800 CCT) and $LED_2$ emits a relatively cool light (e.g., 3000).

In some example embodiments, the light source 400 may be modeled using ideal diodes ($D_1$ or $D_2$) in series with a respective current dependent dynamic resistance as represented by the following equation:

$$V=V_D+iR(i)$$

where the voltage V represents a voltage across each of the first group of LEDs ($LED_1$) and the second group of LEDs ($nLED_2$); $V_D$ equals 2.59 V; and $R(i)=108\ i^2-53\ i+11$.

In some example embodiments, the voltage across the first group of LEDs ($LED_1$) and across the second group of LEDs ($nLED_2$) may be such that the first group of LEDs ($LED_1$) conduct a current while the second group of LEDs ($nLED_2$) does not. To illustrate, when the current (i) is decreased to an amount where the second group of LEDs ($nLED_2$) no longer conducts current to emit a light, the CCT of the light emitted by the light source 400 may transition from Cool White (reflecting the contribution of the second group of LEDs ($nLED_2$)) to Warm White, specifically, from 3000° K to 1800° K or less.

The voltage across the first group of LEDs ($LED_1$) may be represented by the following equation:

$$V=V_D+i_1R(i)$$

The voltage across the second group of LEDs ($nLED_2$), which is the same as the voltage across the first group of LEDs ($LED_{18}$), may be represented by the following equation:

$$V=nV_D+i_2nR(i)$$

The current provided to the light source 400 may be represented by the following equation:

$$i=i_1+i_2,$$

where $i_1$ and $i_2$ are the currents in the first group of LEDs ($LED_1$) and the second group of LEDs ($nLED_2$), respectively. In the above equations, $V_D$ is the ideal diode voltage (e.g., 2.59 V for a single LED, or 25.9V for 10 LEDs in series), and the dynamic resistance $R(i)=108\ i^2-53\ i+11$. n is a multiplier that is greater than 1 (one) and that reflects the addition of one or more LEDs (in series) in the second group of LEDs ($nLED_2$) as compared to the number of LEDs (in series) in the first group of LEDs ($LED_1$).

Figure 5:
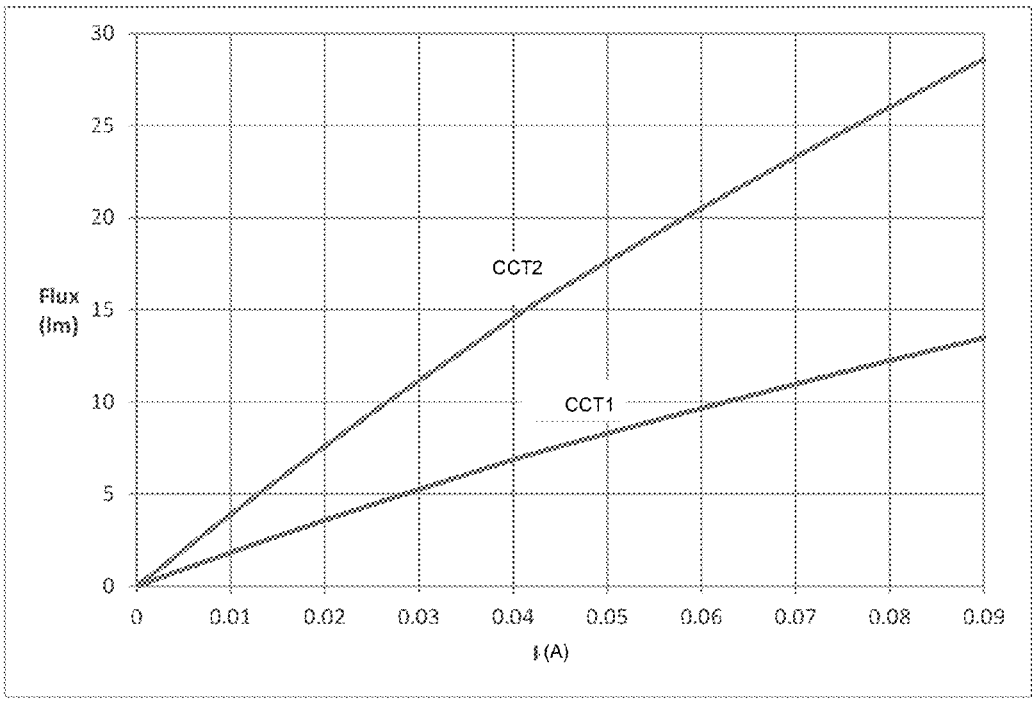
FIG. 5 illustrates a Flux-Current plot of LEDs of a first group of LEDs that emit light having a lower CCT (CCT1) of 1000° K to 2700° K and the LEDs of a second group of LEDs that emit light having a higher CCT (CCT2) of 3000° K to 5000° K.

The above three equations can be solved for the three unknowns, V, $i_1$ and $i_2$, in terms of $V_D$, n and i. The solution equation is a cubic function of $i_1$ of the form:

$$Ai_1^3+Bi_1^2+Ci_1+D=0,$$

where $A=-108(n+1)$; $B=324\ n\ i+53(n-1)$; $C=-324\ n\ i^2-106\ n\ i-11(n+1)$; and $D=2.59(n-1)+108\ n\ i^3+53\ n\ i^2+11\ ni$, and where only real and positive value solutions that belong to the current range are applicable. The solution equation with respect to $i_2$ is also a similar cubic function of $i_2$ and can be determined by the equation $i_2=i-i_1$ When the current through each group of LEDs is determined for all values of the input current (i), the total flux (i.e., the flux of the light resulting from the combination lights emitted by the two groups of LEDs ($LED_1$) and ($nLED_2$)), can be determined from the Flux-Current plot that is supplied by the LED manufacturer of the LEDs. FIG. 5 illustrates a Flux-Current plot of the LEDs of the first group of LEDs ($LED_1$) that emit light having a lower CCT of 2700° K to 1000° K and the LEDs of the second group of LEDs ($nLED_2$) that emit light having a higher CCT of 3000° K to 5000° K.

The Flux-Current relationship for each group of LEDs ($LED_1$) and ($nLED_2$) in FIG. 5, can be approximated by following third order polynomials:

$$\phi_2=2460i_2^3-1230i_2^2+408i_2 \text{ and } \phi_1=1160i_1^3-579i_1^2+193i_1$$

The total flux is represented by $\phi_{Total}=\phi_2+\phi_1$, and the combined CCT (i.e., the CCT of the combined lights emitted by the first group of LEDs ($LED_1$) and the second group of LEDs ($nLED_2$) is approximated as $CCT_{Combined}$ $$CCT_{Combined} \approx \frac{CCT_2{}^\circ\mathrm{K}\cdot\phi_2 + CCT_1{}^\circ\mathrm{K}\cdot\phi_1}{\phi_{Total}}.$$

In some example embodiments, for a known value of n above (e.g., n=1.1 representing that the second group of LEDs ($nLED_2$) has eleven LEDs while the first group of LEDs ($LED_1$) has ten LEDs), a controller/processor may determine the total input current flowing in both groups of LEDs ($LED_1$) and ($nLED_2$) as described above and adjust the CCT of the light emitted by the light source 400 to a desired CCT value. In some alternative embodiments, a lookup table that has a predetermined current-CCT mapping may be used to adjust the CCT of the light emitted by the light source based on the current flowing through either groups of LEDs ($LED_1$) or ($nLED_2$) as determined above for a known value of n.

In some example embodiments, a similar analysis as above may be performed for groups of LEDs that emit lights having CCT values other than 1800° K and 3000° K. In some example embodiments, the second group of LEDs ($nLED_{30}$) may be replaced with another group of LEDs that has the same number of LEDs as the first group of LEDs ($LED_{18}$), where the other group of LEDs is in series with an electrical component, such as one or more diodes.

Figure 6:
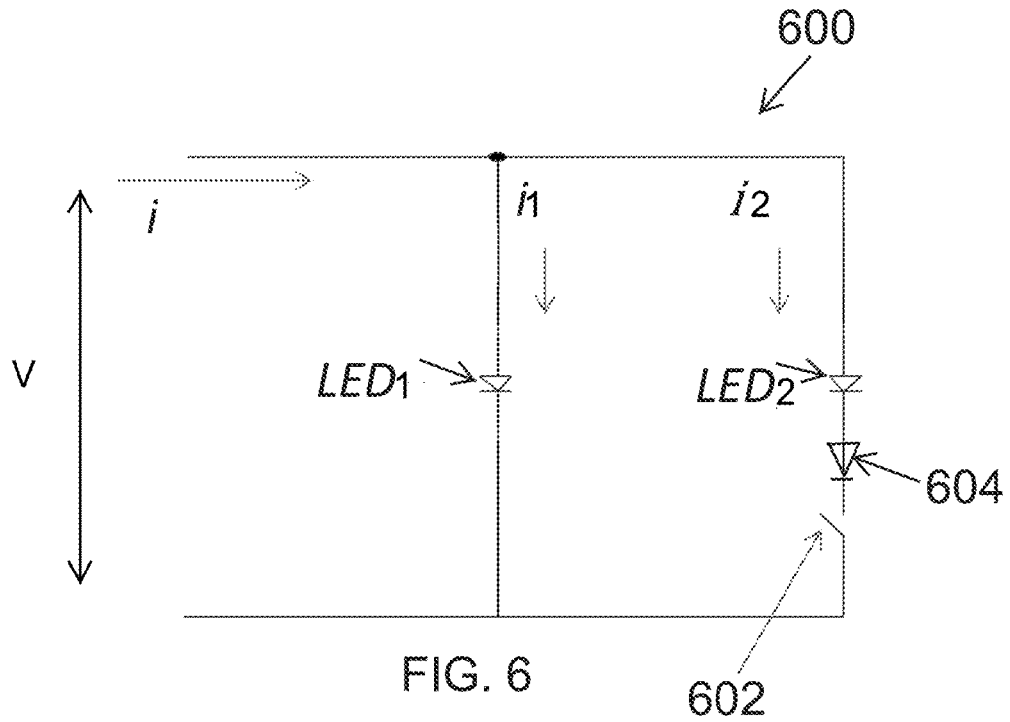
FIG. 6 illustrates a lighting device including two groups of LEDs according to another example embodiment.

FIG. 6 illustrates a lighting device 600 including two groups of LEDs according to another example embodiment. The lighting device 600 includes a first group of LEDs ($LED_1$) that emit a first light having a first CCT. For example, the first group of LEDs ($LED_1$) may include a number of LEDs that are in series with each other. In some example embodiments, the first group of LEDs ($LED_1$) may include multiple subgroups of LEDs where the LEDs in each subgroup are in series with each other, and the different subgroups are parallel with each other. In some example embodiments, the first group of LEDs ($LED_1$) may correspond to the first group of LEDs ($LED_1$) described with respect to FIG. 4.

The light source/source 600 includes a second group of LEDs ($LED_2$) that emit a second light having a second CCT. The second group of LEDs ($LED_2$) may include number of LEDs that are in series with each other. In some example embodiments, the number of LEDs in the second group of LEDs ($LED_2$) is the same as the number of LEDs in the first group of LEDs ($LED_1$). In some example embodiments, the second group of LEDs ($LED_2$) may include LEDs that have the same configurations as described above with respect to the first group of LEDs ($LED_1$).

In some example embodiments, the lighting device 600 includes an active electrical component 604 that is in series with the second group of LEDs ($LED_2$). Because of a voltage drop across the active electrical component 604, the voltage across both the second group of LEDs ($LED_2$) and the active electrical component 604 that is needed for the second group of LEDs ($LED_2$) to start emitting the second light is higher than the voltage across the first group of LEDs ($LED_1$) that is needed for the first group of LEDs ($LED_1$) to start emitting the first light.

In some example embodiments, the lighting device 600 includes a switch 602 coupled in series with the second group of LEDs ($LED_2$) and the electrical component 604. As illustrated in FIG. 6, the first group of LEDs ($LED_1$) is in a parallel configuration with the switch 602, the second group of LEDs ($LED_2$), and the electrical component 604. In some example embodiments, the electrical component 604 is or includes one or more diodes that are in series with each other. Alternatively, the electrical component 604 is or includes one or more LEDs that are in series with each other and that emit a third light having the second CCT. For example, the first CCT may be 1800° K, and the second CCT may be 3000° K. When the electrical component 604 is one or more LEDs that emit a third light having the second CCT, the electrical component 604 and the second group of LEDs ($LED_{30}$) correspond to the second group of LEDs ($nLED_2$) shown in FIG. 4.

In some example embodiments, the switch 602 includes one or more transistors that operate as a switch to enable and disable current flow through the second group of LEDs ($LED_2$), which affects the CCT of the combined light emitted by the lighting device 600.

In some example embodiments, the lighting device 600 includes a controller (such as the controller shown in FIG. 10) that outputs a control signal to open and close the switch 602. For example, the controller may be an integrated circuit device from Microchip Technology (e.g., part number PIC16F1827) or another suitable controller. For example, the controller may control durations of time that the switch 602 is open and closed by controlling a duty cycle of the control signal. To illustrate, increasing a duration of time that the switch 602 is closed may result in a combined light that is cooler (e.g., closer to 3000° K), where the combined light is a combination of at least the first light emitted by the first group of LEDs ($LED_1$) and the second light emitted by the second group of LEDs ($LED_2$). Decreasing the duration of time that the switch 602 is closed may result in the combined light having a warmer color temperature (e.g., closer to 1800° K). The controller may adjust the duty cycle of the control signal to adjust the contribution of the second light (e.g., the second light having a CCT of 3000° K) to the combined light emitted by the lighting device 600, for example, based on a lookup table that current to CCT mapping. For example, the control signal may have a frequency of 1 KHz.

In some example embodiments, the number of parallel groups of LEDs that emit a light that has the first CCT may be less or more than the number of parallel groups of LEDs that emit a light that has the second CCT. For example, the lighting device 600 may include a third group of LEDs that are in series with each other and that emit a third light having the second CCT, where the third group of LEDs is in a parallel configuration with the second group LEDs.

In some example embodiments, the switch 602 may be kept closed (as compared to being toggled) such that current flows through the second group of LEDs ($LED_2$) and the electrical component 604 without disruption by the opening of the switch 604. For example, with the first group of LEDs ($LED_1$) and the second group of LEDs ($LED_2$) having the same number of LEDs that are connected in series within each group, the first group of LEDs ($LED_1$) may start emitting a light, as the voltage V increases, before the second group of LEDs ($LED_2$) because of the additional voltage drop across the electrical component 604 (e.g., an LED that emits a light having the same or substantially the same CCT as the light emitted by the second group of LEDs ($LED_2$)). Similarly, the first group of LEDs ($LED_1$) may continue emitting a light after the second group of LEDs ($LED_2$) seize emitting a light, for example, during dimming down (i.e., the voltage V decreasing) of the overall light emitted by the lighting device 600. In some example embodiments, the first group of LEDs ($LED_1$) and the second group of LEDs ($LED_2$) may operate as desired such that the switch 604 can be kept closed. For example, variations in manufacturing, wear, etc. of the LEDs may be within acceptable ranges. In some example embodiments, the switch 602 may be replaced by a wire (creating a short).

Figure 7:
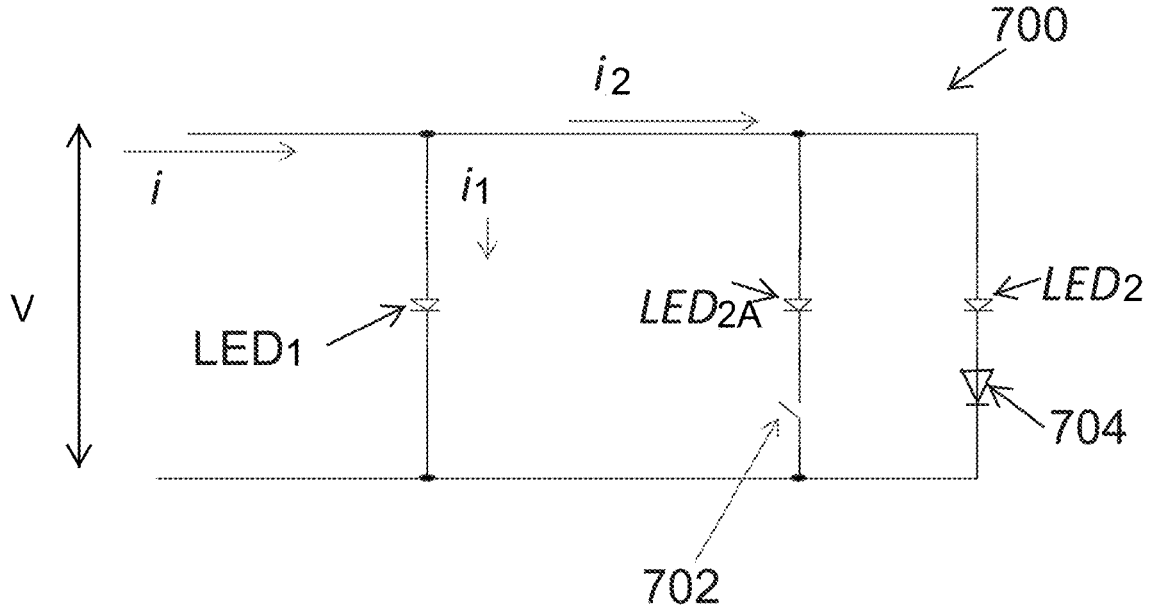
FIG. 7 illustrates a lighting device including three groups of LEDs according to an example embodiment.

FIG. 7 illustrates a lighting device 700 including three groups of LEDs according to an example embodiment. The lighting device 700 includes a first group of LEDs ($LED_1$) that emit a first light having a first CCT. For example, the first group of LEDs ($LED_1$) may include a number of LEDs that are in series with each other. In some example embodiments, the first group of LEDs ($LED_1$) may correspond to the first group of LEDs ($LED_1$) described with respect to FIGS. 4 and 6.

The lighting device 700 may include a second group of LEDs ($LED_2$) that are in series with each other and that emit a second light having a second CCT. For example, the first group of LEDs ($LED_1$) and the second group of LEDs ($LED_2$) may have the same number of LEDs. In some example embodiments, the lighting device 700 may include a third group of LEDs ($LED_{2A}$) that are in series with each other and that emit a third light having the second CCT.

In some example embodiments, the lighting device 700 includes an active electrical component 704 that is in series with the second group of LEDs. Because of a voltage drop across the active electrical component 604, a voltage across both the second group of LEDs ($LED_2$) and the electrical component 704 that is needed for the second group of LEDs ($LED_2$) to start emitting the second light is higher than a voltage across the first group of LEDs ($LED_1$) that is needed for the first group of LEDs ($LED_1$) to start emitting the first light.

In some example embodiments, the lighting device 700 includes a switch 702 coupled in series with the third group of LEDs ($LED_{2A}$). As illustrated in FIG. 7, the first group of LEDs ($LED_1$) is in a parallel configuration with the switch 602 and the third group of LEDs ($LED_{2A}$), and with the second group of LEDs ($LED_2$) and the electrical component 704.

In some example embodiments, the electrical component 704 is or includes one or more diodes that are in series with each other. Alternatively, the electrical component 704 is or includes one or more LEDs that are in series with each other and that emit a fourth light having the second CCT. For example, the first CCT may be 1800° K, and the second CCT may be 3000° K. When the electrical component 704 is one or more LEDs that emit a fourth light having the second CCT, the electrical component 704 and the second group of LEDs ($LED_2$) correspond to the second group of LEDs ($nLED_2$) shown in FIG. 4.

In some example embodiments, the switch 702 includes one or more transistors that operate as a switch to alternatingly enable and disable current flow through the second group of LEDs ($LED_2$), which affects the CCT of the combined light emitted by the lighting device 700.

In some example embodiments, the lighting device 700 includes a controller (such as the controller shown in FIG. 10) that outputs a control signal to open and close the switch 602. For example, the controller may control durations of time that the switch 602 is open and closed by controlling a duty cycle of the control signal. To illustrate, increasing a duration of time that the switch 702 is closed may result in the combined light emitted by the lighting device 700 having a cooler color temperature (e.g., closer to 3000° K). Decreasing the duration of time that the switch 702 is closed and reducing the current provided to the lighting device 700 may result in the combined light having a warmer color temperature (e.g., closer to 1800° K). The controller may adjust the duty cycle of the control signal to adjust the contribution of the third light (e.g., the third light having a CCT of 3000° K) to the combined light emitted by the lighting device 700, for example, based on a lookup table that has a current-CCT mapping. For example, the control signal may have a frequency of 1 KHz.

In some example embodiments, the switch 602 may be kept open (as compared to being toggled) such that current does not flow through the third group of LEDs ($LED_{2A}$). For example, with the first group of LEDs ($LED_1$) and the second group of LEDs ($LED_2$) having the same number of LEDs that are connected in series within each group, the first group of LEDs ($LED_1$) may start emitting a light, as the voltage V increases, before the second group of LEDs ($LED_2$) because of the additional voltage drop across the electrical component 704 (e.g., an LED that emits a light having the same or substantially the same CCT as the light emitted by the second group of LEDs ($LED_2$)). Similarly, the first group of LEDs ($LED_1$) may continue emitting a light after the second group of LEDs ($LED_2$) seize emitting a light, for example, during dimming down (i.e., the voltage V decreasing) of the overall light emitted by the lighting device 700. To illustrate, in some example embodiments, the first group of LEDs ($LED_1$) and the second group of LEDs ($LED_2$) may operate as desired such that the switch 704 can be kept open. For example, variations in manufacturing, wear, etc. of the LEDs may be within acceptable ranges. In some example embodiments, the switch 702 and the third group of LEDs ($LED_{2A}$) may be omitted.

Figure 8:
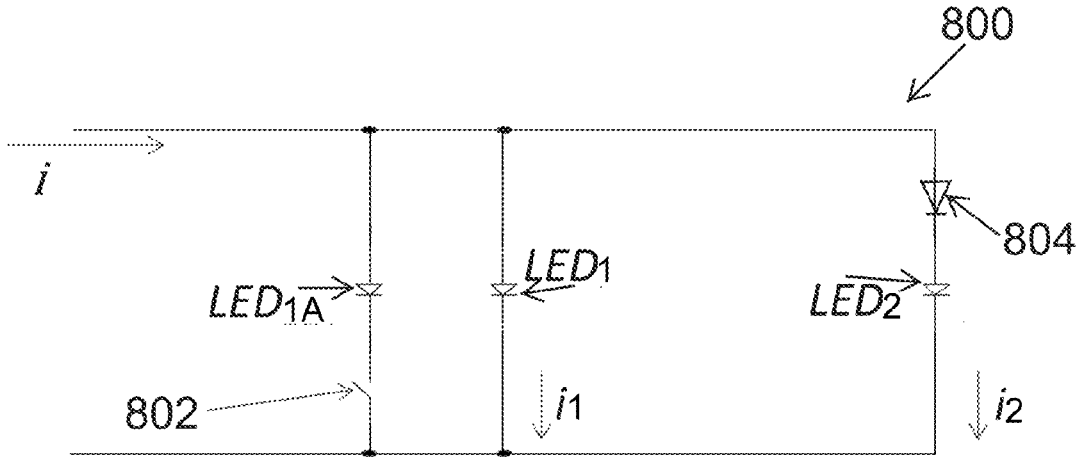
FIG. 8 illustrates a lighting device including three groups of LEDs according to another example embodiment.

FIG. 8 illustrates a lighting device 800 including three groups of LEDs according to another example embodiment. The light device 800 includes a first group of LEDs ($LED_1$) that emit a first light having a first CCT. For example, the first group of LEDs ($LED_1$) may include a number of LEDs that are in series with each other. In some example embodiments, the first group of LEDs ($LED_1$) may correspond to the first group of LEDs ($LED_1$) described with respect to FIGS. 4 and 6.

The lighting device 800 may include a second group of LEDs ($LED_2$) that are in series with each other and that emit a second light having a second CCT. For example, the first group of LEDs ($LED_1$) and the second group of LEDs ($LED_2$) may have the same number of LEDs. In some example embodiments, the lighting device 800 may include a third group of LEDs ($LED_{1A}$) that are in series with each other and that emit a third light having the first CCT.

In some example embodiments, the lighting device 800 includes a switch 802 coupled in series with the third group of LEDs ($LED_{1A}$). As illustrated in FIG. 8, the first group of LEDs ($LED_1$) is in a parallel configuration with the switch 702 and the third group of LEDs ($LED_{1A}$), and with the second group of LEDs ($LED_2$) and the electrical component 804.

In some example embodiments, the electrical component 804 is or includes one or more diodes that are in series with each other. Alternatively, the electrical component 804 is or includes one or more LEDs that are in series with each other and that emit a fourth light having the second CCT. For example, the first CCT may be 1800° K, and the second CCT may be 3000° K. When the electrical component 804 is one or more LEDs that emit the fourth light having the second CCT, the electrical component 804 and the second group of LEDs ($LED_2$) correspond to the second group of LEDs ($nLED_2$) shown in FIG. 4.

In some example embodiments, the switch 802 includes one or more transistors that operate as a switch to alternatingly enable and disable current flow through the second group of LEDs ($LED_2$), which affects the CCT of the combined light emitted by the lighting device 800.

In some example embodiments, the lighting device 800 includes a controller (such as the controller shown in FIG. 10) that outputs a control signal to open and close the switch 802. For example, the controller may control durations of time that the switch 802 is open and closed by controlling a duty cycle of the control signal. To illustrate, increasing a duration of time that the switch 802 is closed may result in the combined light emitted by the lighting device 800 having a warmer color temperature (e.g., closer to 1800° K). Decreasing the duration of time that the switch 802 is closed may result in the combined light having a cooler color temperature. The controller may adjust the duty cycle of the control signal to adjust the contribution of the third light (e.g., the third light having a CCT of 1800° K) to the combined light emitted by the lighting device 800, for example, based on a lookup table that has a current-CCT mapping. For example, the control signal may have a frequency of 1 KHz.

In some example embodiments, the switch 802 and the third group of LEDs ($LED_{1A}$) may be omitted.

Figure 9:
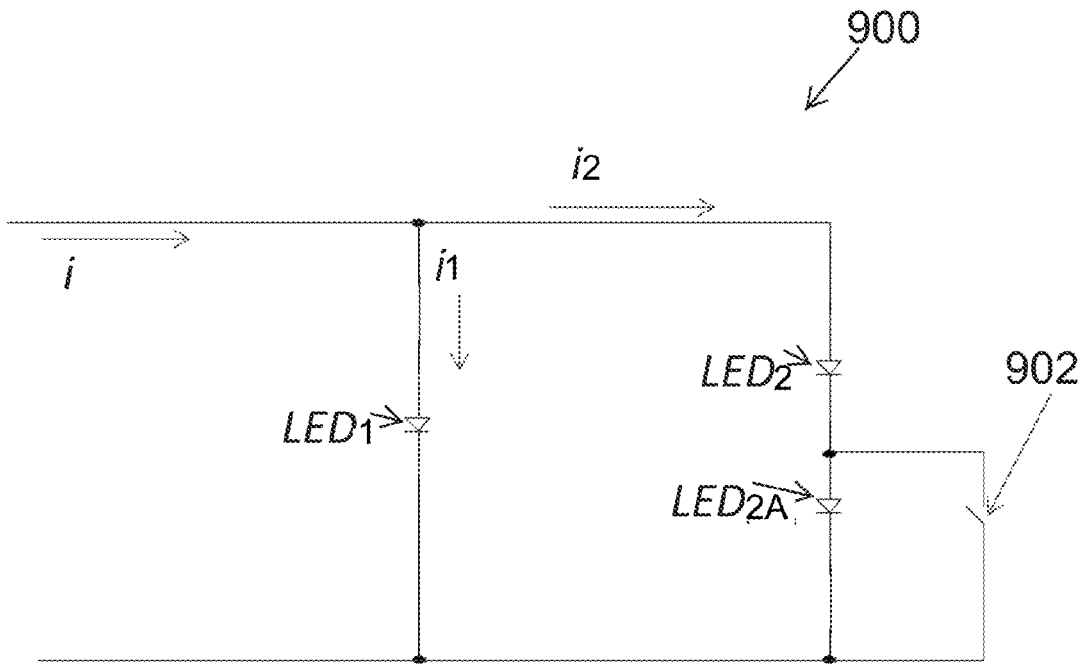
FIG. 9 illustrates a lighting device including three groups of LEDs according to another example embodiment.

FIG. 9 illustrates a lighting device 900 including three groups of LEDs according to another example embodiment. The light device 900 includes a first group of LEDs ($LED_1$) that emit a first light having a first CCT. For example, the first group of LEDs ($LED_1$) may include a number of LEDs that are in series with each other. In some example embodiments, the first group of LEDs ($LED_1$) may correspond to the first group of LEDs ($LED_1$) described with respect to FIGS. 4 and 6.

The lighting device 900 may include a second group of LEDs ($LED_2$) that are in series with each other and that emit a second light having a second CCT. For example, the first group of LEDs ($LED_1$) and the second group of LEDs ($LED_2$) may have the same number of LEDs. In some example embodiments, the lighting device 900 may include a third group of LEDs ($LED_{2A}$) that are in series with each other and that emit a third light having the second CCT.

In some example embodiments, the lighting device 900 includes a switch 902 coupled in parallel with the third group of LEDs ($LED_{2A}$). By toggling the switch 902, the contribution of the third light emitted by the third group of LEDs ($LED_{2A}$) to the combined light emitted by the lighting device 900 may be controlled. To illustrate, the switch 902 may include one or more transistors that operate as a switch to alternatingly enable and disable current flow through the third group of LEDs ($LED_{2A}$), which affects the CCT of the combined light emitted by the lighting device 900.

In some example embodiments, the lighting device 900 includes a controller (such as the controller shown in FIG. 10) that outputs a control signal to open and close the switch 902. For example, the controller may control durations of time that the switch 902 is open and closed by controlling a duty cycle of the control signal. The controller may adjust the duty cycle of the control signal to adjust the contribution of the third light (e.g., the third light having a CCT of 1800° K) to the combined light emitted by the lighting device 900, for example, based on a lookup table that has a current-CCT mapping. For example, the control signal may have a frequency of 1 KHz.

Figure 10:
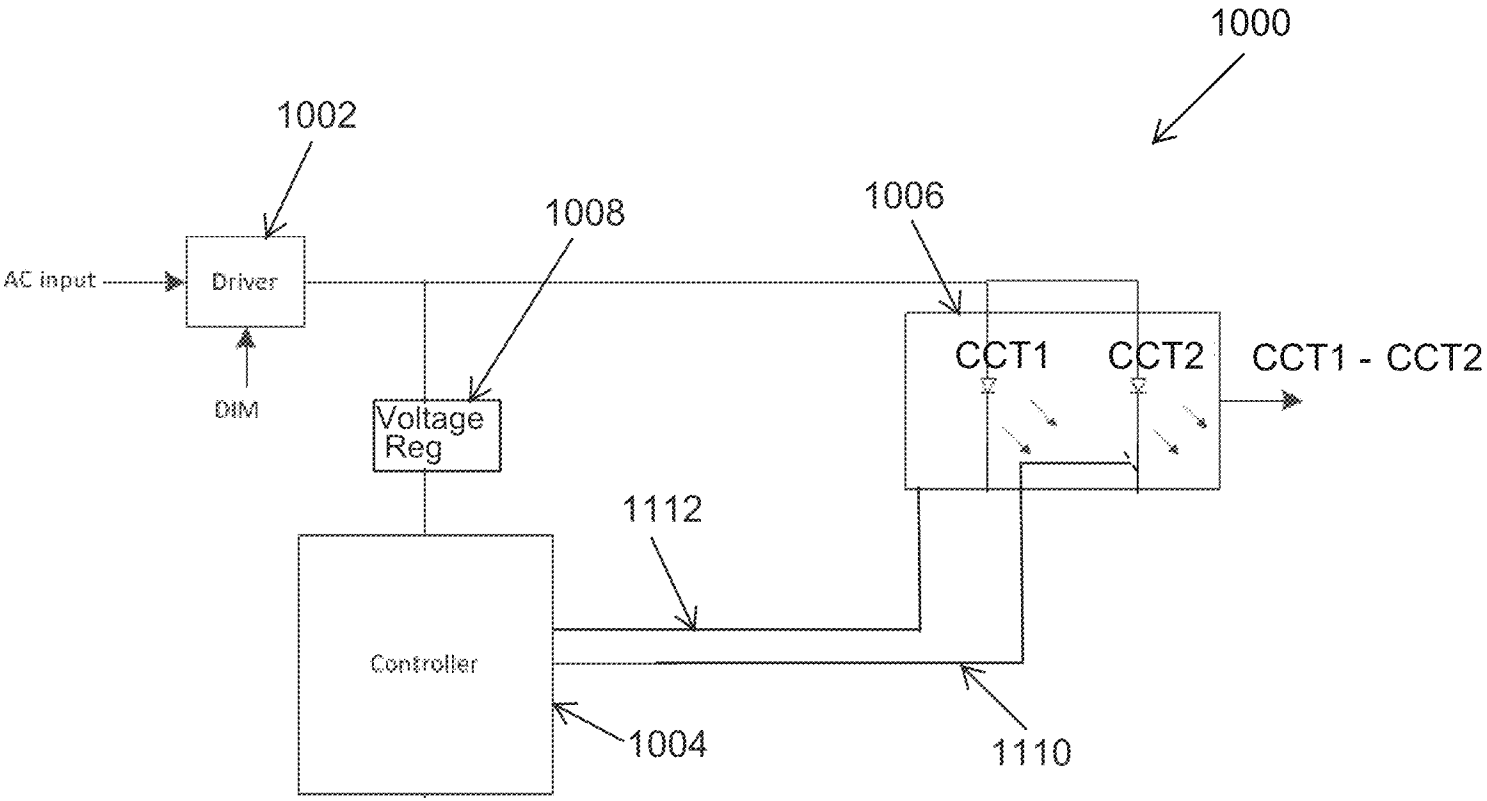
FIG. 10 is illustrates a system for adjusting the color temperature of a light according to an example embodiment The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, reference numerals designate like or corresponding, but not necessarily identical, elements.

FIG. 10 is illustrates a system 1000 for adjusting the color temperature of a light according to an example embodiment. The system 1000 includes a driver 1002 such as an LED driver that, for example, provides output current to power a light source such as one or more LEDs. The driver 1002 receives an AC (alternating current) input, for example, from a mains power supply and provides power to a controller 1004 via a regulator 1008 that adjusts the voltage level that is seen by the controller 1002. The controller may be an integrated circuit device from Microchip Technology (e.g., part number PIC16F1827) or another suitable controller.

The driver 1002 also provides power to the lighting device 1006 that may include two or more groups of LEDs. For example, the lighting device 1006 may correspond to the lighting device 600 of FIG. 6. Alternatively, the lighting device 1006 may be replaced by one of the lighting devices of FIGS. 6-9. The controller 1004 may provide a control signal via connection 1110 to control (i.e., open and close) a switch, such as the switch 602 shown in FIG. 6, to adjust the color temperature of the light emitted by the lighting device 1006. For example, the controller 1004 may adjust the duty cycle of the control signal to change the on or off durations of the switch, which may be one or more transistors.

In some example embodiments, the controller 1004 may sense the total current flowing through groups of LEDs of the lighting device 1006 via the connection 1112 to adjust the CCT of the light emitted by the lighting device 1006, for example, by adjusting the duty cycle of the control signal based on a lookup table that has a predetermined current-CCT mapping. In some example embodiments, the controller 1004 may adjust the duty cycle of the control signal to produce a warmer light (e.g., 1800° K) at low dim levels. In some example embodiments, the controller 1004 may adjust the duty cycle of the control signal to produce a cooler light (e.g., 3000° K) at high dim levels.

In some example embodiments, the switch 902 may be omitted. Alternatively, the switch 902 may be permanently kept open.

Although particular embodiments have been described herein in detail, the descriptions are by way of example. The features of the example embodiments described herein are representative and, in alternative embodiments, certain features, elements, and/or steps may be added or omitted. Additionally, modifications to aspects of the example embodiments described herein may be made by those skilled in the art without departing from the spirit and scope of the following claims, the scope of which are to be accorded the broadest interpretation so as to encompass modifications and equivalent structures.

What is claimed is:

1. A lighting device, comprising:

a first group of light emitting diodes (LEDs) that are in series with each other and that emit a first light having a first correlated color temperature (CCT);

a second group of LEDs that are in series with each other and that emit a second light having a second CCT;

a transistor in series with the second group of LEDs, wherein a voltage across the transistor is varied to set a threshold level associated with a current provided to the second group of LEDs while dimming the lighting device; and a driver that provides a total current to the first group of LEDs and the second group of LEDs, wherein a voltage across both the second group of LEDs and the transistor that is needed for the second group of LEDs to start emitting the second light is higher than a voltage across the first group of LEDs that is needed for the first group of LEDs to start emitting the first light, wherein a forward voltage of the second group of LEDs is equal to or lower than a forward voltage of the first group of LEDs, and wherein, when the current provided to the second group of LEDs is reduced to below the threshold level due to dimming, a controller that senses the total current provides a control signal to turn on the transistor causing the second group of LEDs to stop emitting the second light while the first group of LEDs continues to emit the first light.

2. The lighting device of claim 1, further comprising one or more diodes that are in series with each other and the second group of LEDs.

3. The lighting device of claim 1, further comprising one or more LEDs that are in series with each other and the second group of LEDs and that emit a third light having the second CCT.

4. The lighting device of claim 3, wherein the controller provides the control signal to turn off the transistor.

5. The lighting device of claim 4, wherein the processor controls durations of time that the transistor is turned on and off by controlling a duty cycle of the control signal, wherein increasing a duration of time that the transistor is turned on results in a combined light that is cooler, wherein the combined light is a combination of at least the first light emitted by the first group of LEDs and the second light emitted by the second group of LEDs.

6. The lighting device of claim 3, wherein the first CCT is 1000 K to 2700 K and the second CCT is 3000 K to 5000 K.

7. The lighting device of claim 3, further comprising a third group of LEDs that are in series with each other, wherein the third group of LEDs is in a parallel configuration with the second group LEDs and wherein the third group of LEDs emit a third light having the second CCT.

8. A lighting device, comprising:

a first group of light emitting diodes (LEDs) that are in series with each other and that emit a first light having a first correlated color temperature (CCT);

a second group of LEDs that are in series with each other and that emit a second light having a second CCT;

a third group of LEDs that are in series with each other and that emit a third light having the second CCT, wherein the first group of LEDs, the second group of LEDs, and the third group of LEDs are coupled to a node;

a transistor in series with the second group of LEDs, wherein a voltage across the transistor is varied to set a threshold level associated with a current provided to the second group of LEDs while dimming the lighting device;

a driver that provides a total current to the first group of LEDs, the second group of LEDs, and the third group of LEDs, wherein a voltage across both the second group of LEDs and the transistor that is needed for the second group of LEDs to start emitting the second light is higher than a voltage across the first group of LEDs that is needed for the first group of LEDs to start emitting the first light, wherein, when a current provided to the second group of LEDs is reduced to below the threshold level due to dimming, a controller that senses the total current provides a control signal to turn on the transistor causing the second group of LEDs to stop emitting the second light while the first group of LEDs continues to emit the first light.

9. The lighting device of claim 8, further comprising one or more diodes that are in series with each other and the second group of LEDs.

10. The lighting device of claim 8, further comprising one or more LEDs that are in series with each other and the second group of LEDs and that emit a fourth light having the second CCT.

11. The lighting device of claim 10, wherein the controller provides the control signal to turn off the transistor.

12. The lighting device of claim 11, wherein the processor controls durations of time that the transistor is turned on and off by controlling a duty cycle of the control signal, wherein increasing a duration of time that the transistor is turned on results in a combined light that is cooler, wherein the combined light is a combination of at least the first light emitted by the first group of LEDs and the second light emitted by the second group of LEDs.

13. The lighting device of claim 10, wherein the first CCT is 1000 K to 2700 K and the second CCT is 3000 K to 5000 K.

14. A lighting device, comprising:

a first group of light emitting diodes (LEDs) that are in series with each other and that emit a first light having a first correlated color temperature (CCT);

a second group of LEDs that are in series with each other and that emit a second light having a second CCT;

a third group of LEDs that are in series with each other and that emit a third light having the first CCT, wherein the first group of LEDs, the second group of LEDs, and the third group of LEDs are coupled to a node;

a transistor in series with the second group of LEDs, wherein a voltage across the transistor is varied to set a threshold level associated with a current provided to the second group of LEDs while dimming the lighting device;

a driver that provides a total current to the first group of LEDs, the second group of LEDs, and the third group of LEDs, wherein a voltage across both the second group of LEDs and the transistor that is needed for the second group of LEDs to start emitting the second light is higher than a voltage across the first group of LEDs that is needed for the first group of LEDs to start emitting the first light, wherein, when a current provided to the second group of LEDs is reduced to below the threshold level due to dimming, a controller that senses the total current provides a control signal to turn on the transistor causing the second group of LEDs to stop emitting the second light while the first group of LEDs continues to emit the first light.

15. The lighting device of claim 14, further comprising one or more LEDs that are in series with each other and the second group of LEDs and that emit a fourth light having the second CCT.

16. The lighting device of claim 15, wherein the controller provides the control signal to turn off the transistor.

17. The lighting device of claim 15, wherein the processor controls durations of time that the transistor is turned on and off by controlling a duty cycle of the control signal, wherein increasing a duration of time that the transistor is turned on results in a combined light that is cooler, wherein the combined light is a combination of at least the first light emitted by the first group of LEDs and the second light emitted by the second group of LEDs.

18. The lighting device of claim 15, wherein the first CCT is 1000 K to 2700 K and the second CCT is 3000 K to 5000 K.

* * * * *